US006088835A

United States Patent [19]

Perkins et al.

[11] Patent Number: 6,088,835

[45] Date of Patent: Jul. 18, 2000

[54] SWIMMING AND SURFING GLOVE

[76] Inventors: Kiel Perkins; Liza Mandala McCullough, both of P.O. Box 9, Laguna Beach, Calif. 92651

[21] Appl. No.: 09/359,618

[22] Filed: Jul. 22, 1999

[51] Int. Cl.[7] ..... A41D 19/00

[52] U.S. Cl. ..... 2/161.1; 2/163; 441/56

[58] Field of Search ..... 2/159, 161.1, 161.5, 2/161.6, 163, 167; 441/56, 57

[56] References Cited

U.S. PATENT DOCUMENTS

| | | | |
|---|---|---|---|
| 458,888 | 9/1891 | Eisele | 2/159 |
| 1,437,310 | 11/1922 | Ingram | 2/159 |
| 1,669,010 | 5/1928 | Natho | 2/159 |
| 1,746,268 | 2/1930 | Lepetich | 2/159 |
| 3,231,910 | 2/1966 | Tegland | 441/57 |
| 4,027,347 | 6/1977 | Sato | 9/308 |

*Primary Examiner*—Diana Oleksa
*Assistant Examiner*—Katherine Moran

[57] ABSTRACT

Disclosed is an article of apparel which is specifically designed for participants of water activities. The apparel, which can take the form of hand and/or foot coverings, enables the wearer to more easily and efficiently navigate in underwater conditions. Thus, the apparel is ideally suited for use by surfers, body board users, and/or scuba divers. Nonetheless, the present invention can be employed with any number of aquatic activities. In general terms, the apparel of the present invention includes a limb stall to which a number of digit stalls are connected. Such stalls are employed in receiving the extremities of a user. Furthermore, the apparel includes a number of webbing sections as well as a dorsal chute. These portions of the apparel advantageously provide drag thus increasing maneuverability in underwater conditions.

8 Claims, 6 Drawing Sheets

SWIMMING AND SURFING GLOVE

BACKGROUND OF THE INVENTION

1. Field of the Invention

The present invention relates to a swimming and surfing glove, and more particularly to a glove with a dorsal chute and webbing for use in creating aquadynamic effects.

2. Description of Related Art

Prior art swimming gloves typically employ a planar web for use in creating drag. However, such planar surfaces create areas about which water cannot travel. This results in the hand under going great stresses throughout underwater activities. One example of this is illustrated in U.S. Pat. No. 4,669,991 to Southwarth which discloses a swimming glove construction. Similarly, U.S. Pat. No. 4,746,313 to Bray discloses a webbed swimming aid. U.S. Design Pat. No. 342,773 to Chen discloses a swimming glove with a frog palm shape. U.S. Pat. No. 4,923,481 to Hoffman discloses an exercise glove construction. Furthermore, U.S. Pat. No. 4,618,328 to Chia and 4,058,863 to Ferdico disclose swimming glove constructions.

None of these devices, however, allow the bowing of the control surfaces to allow for increased drag while at the same time reducing the amount of stress which a user undergoes.

Therefore, it can be appreciated that there exists a continuing need for a new and improved swimming and surfing glove which can be used for increasing the amount of drag which is created, while at the same time reducing the amount of effort and energy required to move through the water. In this regard, the present invention substantially fulfills this need.

BRIEF SUMMARY OF THE INVENTION

The general purpose of the present invention is to provide a swimming and surfing glove which allows for increased drag while at the same time not interfering with underwater maneuverability. To attain this, the present invention essentially comprises a limb stall having a first opened end adapted to accept the body part of a user. The plurality of digit stalls are included at the opposite second end and an intermediate portion is also included. A limb stall is included and has both a dorsal side and a front side. A dorsal chute is formed upon the dorsal side of the limb stall. The dorsal chute is secured at a number of discrete locations. A central opening is formed within the dorsal chute. A length of cabling is formed within the periphery of the opening to allow the opening to be adjusted to various sizes.

It is therefore an object of the present invention to provide an article of underwater apparel which increases floatability while at the same time decreasing the effort which is needed to maneuver the article in underwater environments.

It is another object of the present invention to provide underwater apparel which encourages dexterity in underwater work environments and increases the efficiency of transmission of power.

An even further object of the present invention is to provide an article of underwater apparel which has a number of textured regions to allow a user to maintain control over various objects in underwater environments.

Even still another option of the present invention is to create an article of underwater apparel which promotes liquid propulsion.

Lastly, it is an object of the present invention to provide an article of apparel for use by participants in water activities. The limb stall has a first opened end adapted to accept the body part of a user. The first, second, third, fourth, and fifth, digit stalls are at the opposite second end. An intermediate portion is located therebetween. The limb stall has both a dorsal side and a front side. A series of textured surfaces cover each of the digit stalls. These series of textures include an oval textured pattern at the outermost front side of each digit stall and two textured sections formed along the intermediate length of the second, third, fourth, and fifth digit stalls. A dorsal chute is formed upon the dorsal side of the limb stall. The dorsal chute is secured at a number of discrete locations. Specifically, the two discrete locations are at the opened first end of the limb stall, at two discrete locations at either side of the intermediate portion of the limb stall, and at discrete locations at the base of the first, second, third, fourth, and fifth digit stalls. A central opening is formed within the dorsal chute, a length of cabling is formed within the periphery of the opening to allow the opening to be adjusted to various sizes. A first webbing section is secured to the dorsal side of the limb stall. The first web covers the region between the first and second digit stalls. A second webbing is secured to the dorsal side of the limb stall, the second web covers the region between the second and third digit stalls. A third webbing is secured to the dorsal side of the limb. The third web covers the region between the third and fourth digit stalls. The fourth webbing is secured to the dorsal side of the limb stall. The fourth webbing covers the region between the fourth and fifth digit stalls. A first pair of harnesses interconnects the second and third digit stalls at their intermediate lengths. A second pair of harnesses is secured to the third and fourth digit stalls intermediate their length. A lone harness interconnects the fourth and fifth digit stalls along their intermediate length.

BRIEF DESCRIPTION OF THE SEVERAL VIEWS OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DETAILED DESCRIPTION OF THE INVENTION

The present invention relates to an article of apparel which is specifically designed for participants of water activities. The apparel, which can take the form of hand and/or foot coverings, enables the wearer to more easily and efficiently navigate in underwater conditions. Thus, the apparel is ideally suited for use by surfers, body board users, and/or scuba divers. Nonetheless, the present invention can be employed with any number of aquatic activities. In general terms, the apparel of the present invention includes a limb stall to which a number of digit stalls are connected. Such stalls are employed in receiving the extremities of a user. Furthermore, the apparel includes a number of webbing sections as well as a dorsal chute. These portions of the apparel advantageously provide drag thus increasing maneuverability in underwater conditions. The various components of the present invention, and the manner in which they interrelate, will be described in greater detail hereinafter.

Figure 1:
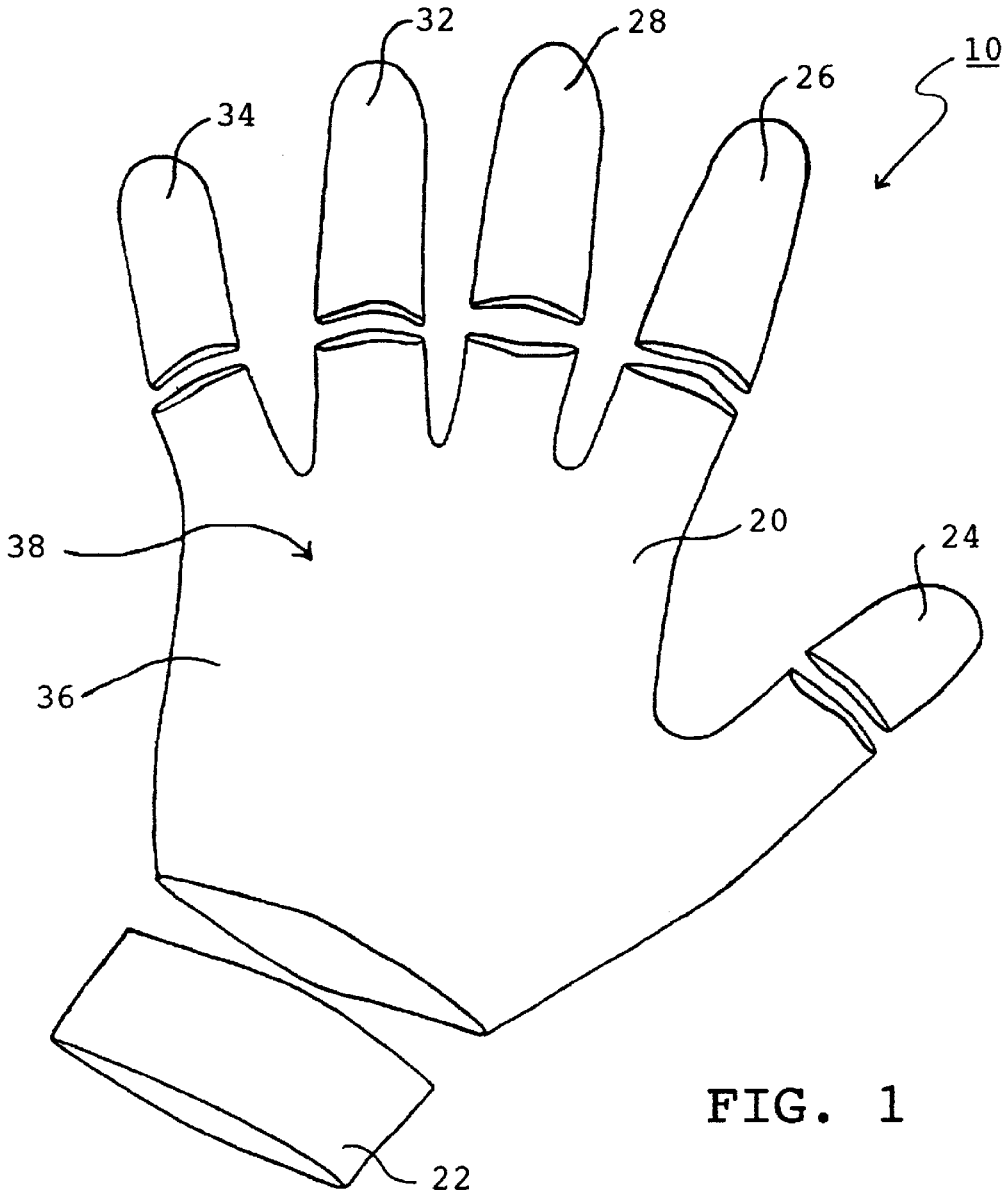
FIG. 1 is a perspective illustration of the preferred embodiment of the swimming and surfing glove constructed in accordance with the principles of the present invention.

With reference now to FIG. 1, the major component of the apparel is depicted. The apparel 10 takes the form of a glove-like article which employs both a limb stall 20 and a number of associated digit stalls. The limb stall 20 is defined by a first opened end 22 which is adapted to accept the body part or extremity of a user. FIG. 1 illustrates the components as being multipart. However, the article is preferably integrally formed. The separations indicate that various sizes can be constructed. Ideally, five digit stalls are included. With continuing reference to FIG. 1, these stalls are designated, from right to left, the first 24, second 26, third 28, fourth 32, and fifth 34 digit stalls respectively. Thus, the first digit stall 24 corresponds to the thumb, the second digit stall 26 corresponds to the index finger, the third digit stall 28 corresponds to the middle finger, the fourth digit stall 32 corresponds to the ring finger, and the fifth digit stall 34 corresponds to the pinky finger. As is evident, these digit stalls are integrally formed opposite the first end 22 of the limb stall 20. The limb stall 20 is further defined by an intermediate portion 36 which on the dorsal side 38 corresponds to the back of a user's hand, and which on the front side 42 corresponds to the palm of a user's hand. The limb stall 20 thus described and illustrated corresponds to the hand of a user. Yet, the present invention could be readily adapted for use upon a user's foot or other such extremities.

Figure 4:
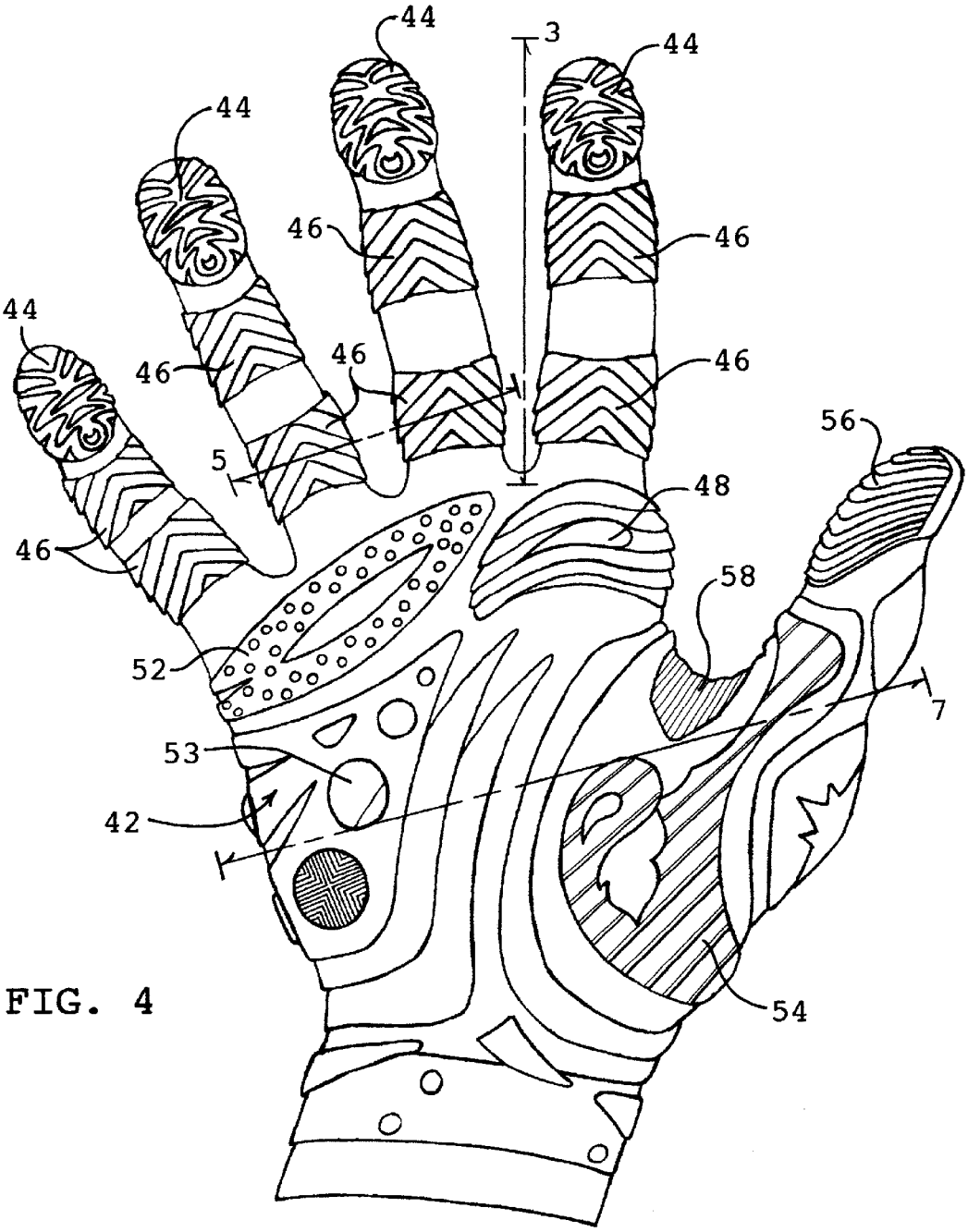
FIG. 4 is a plan view of the palmar region of the glove of the present invention.
Figure 6:
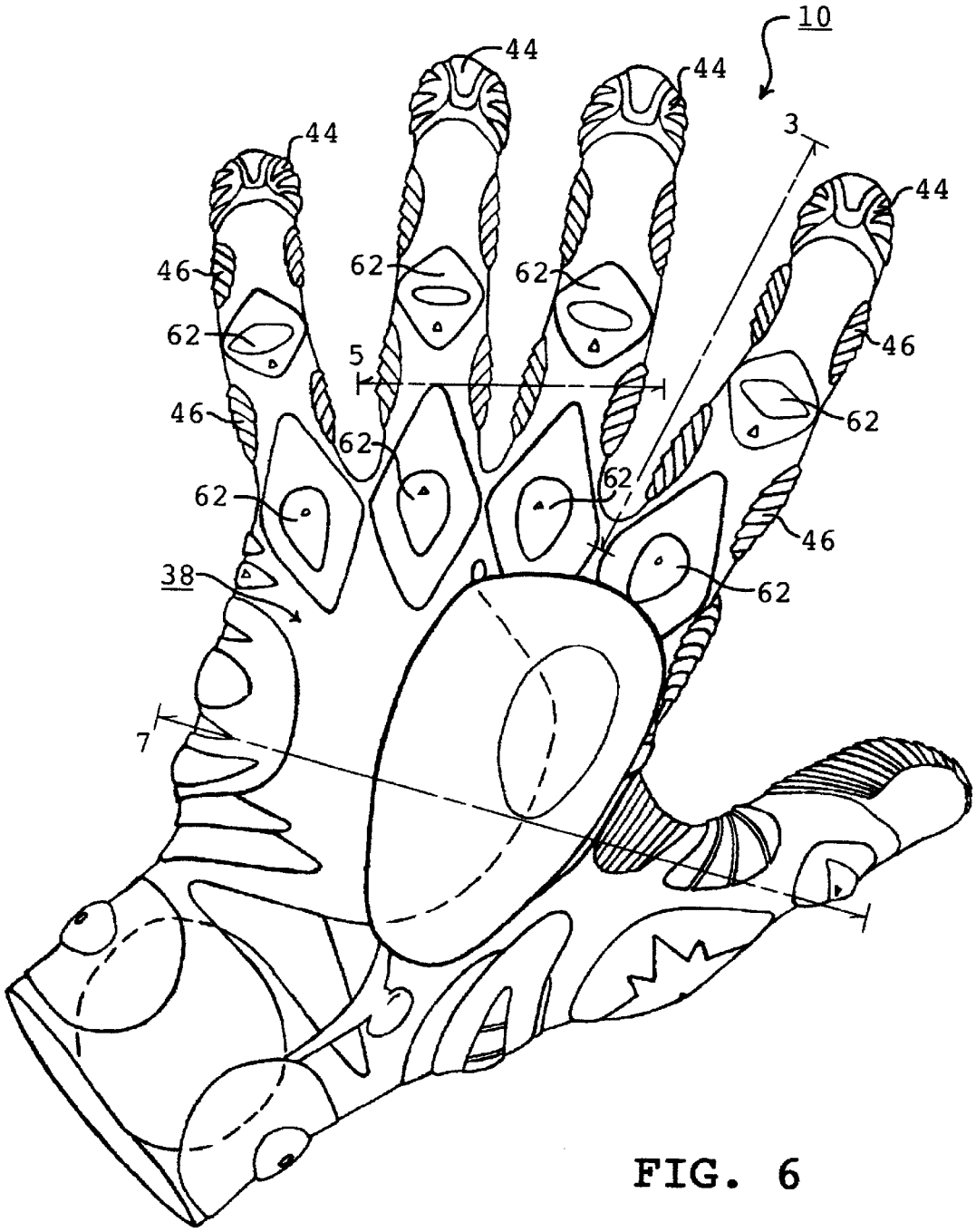
FIG. 6 is a view of the front side of the apparel of the present invention.
Figure 8:
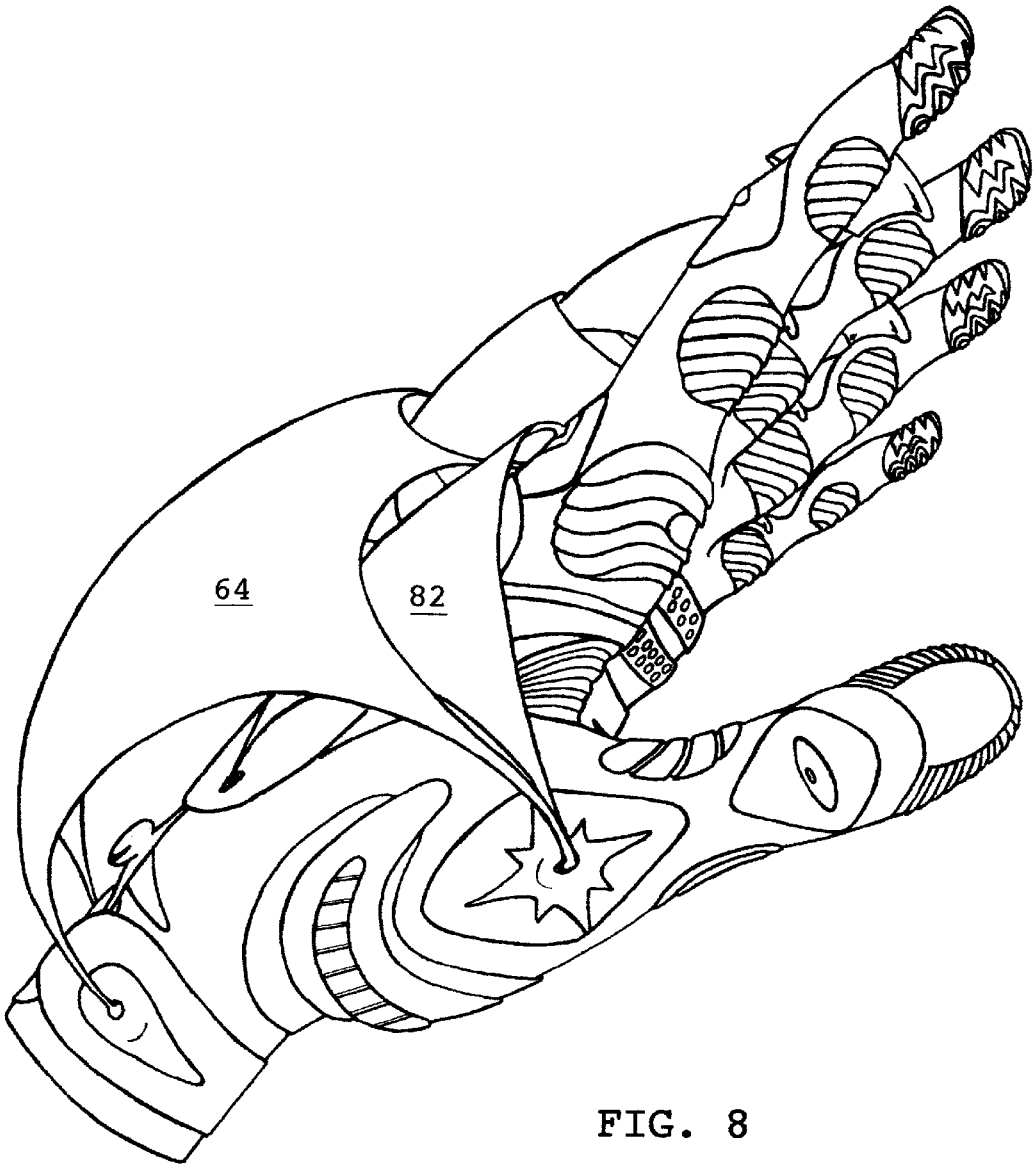
FIG. 8 is perspective illustration of the apparel of the present invention.

FIGS. 4, 6, and 8 illustrate the various textured patterns which are associated with the limb and digit stalls. These textured surfaces have been found to provide an optimal gripping action for the wearer. With specific reference to FIGS. 4 and 6, the series of textured surfaces which cover each of the digit stalls is detailed. This series of textures includes an oval textured pattern 44 formed at the outermost front side of the second 26, third 28, fourth 32, and fifth 34 digits. Ideally, the textured pattern takes the form of a starburst type configuration. FIG. 6 illustrates that the starburst pattern extends about to the dorsal side of each fingertip. The fingertip textured pattern 44 is critical insomuch as the fingertips are primarily used in controlling and manipulating items such as the ankle collars associated with conventional surfboards. Two other textured sections are included along the intermediate length of the second 26, third 28, fourth 32, and fifth 34 digit stalls. These textured patterns 46 take the form of 90 degree ridges. Again FIG. 6 illustrates that the 90 degree patterns 46 extend, to a limited degree, to the dorsal side of the second 26, third 28, fourth 32, fifth 34 digit stalls.

With reference again to FIG. 4, the various textures and patterns associated with the palmar region 42 of the limb stall 20 are depicted. Specifically, two oval shaped areas are provided near the base of the second 26, third 28, fourth 32, and fifth 34 digit stalls. The first of these areas 48 is formed into a number of overlapping ridges with a teardrop shaped central region. The second area 52 is formed adjacent the first and includes a series of dimples. The second area 52 includes an elliptical central region. Additionally, the palmar region 42 beneath the dimpled area includes a textured region employing a series of circles 53. Opposite this is a palmar region which includes a series of grooves 54. Finally, the tip of the fist digit stall 24, or the thumb stall, includes a series of overlapping regions 56 which provide a gripping surface for the users thumb. Additionally, an accordion-shaped region 58 is provided intermediate the first digit stall 24 and second digit stall 26—or between the thumb and the index finger. FIG. 6 illustrates the textured and patterned regions associated with the dorsal side 38 of the article 10. These areas include knuckle gusset regions 62 which overlay the upper and lower knuckles of each digit. These gussets 62 provided the necessary degree of flexibility so it is not to impede a user's range of motion. The textured regions associated with the apparel have thus been described generally. Other regions can be included to provide increased gripping or to provide a decorative appearance.

Figure 2:
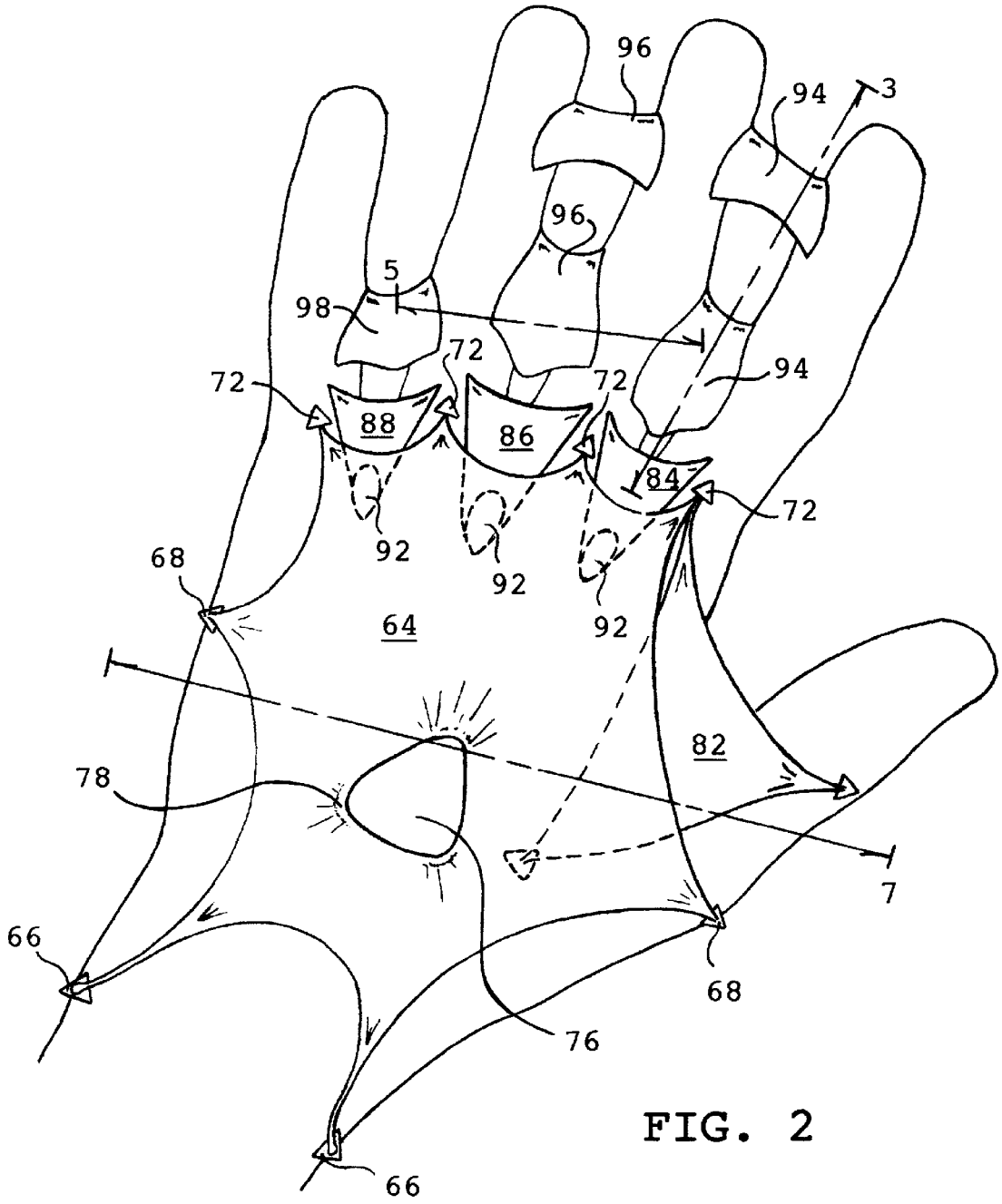
FIG. 2 is a plan view of the glove with the dorsal chutes, webbing, and harnesses depicted, however, the textured regions are not shown for clarity.
Figure 3:
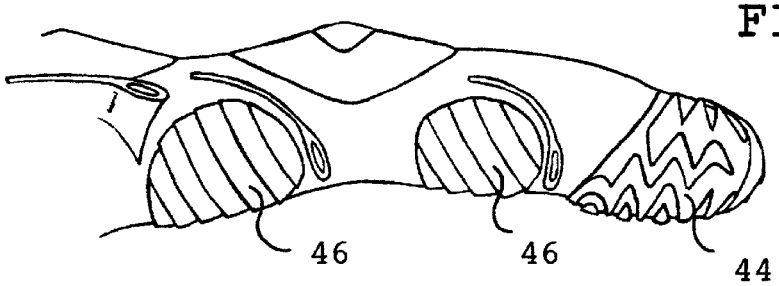
FIG. 3 is a elevational view of one limb stall of the present invention.

The chute, webbing, and harnesses which are associated with the article of the present invention will next be described. With reference to FIG. 8, the dorsal chute 64 is depicted in its fully extended or deployed configuration. The chute 64 is, in the preferred embodiment, secured at a number of discrete locations to the dorsal side 38 of the limb stall 20. These discrete locations are most clearly seen with reference to FIG. 2. Specifically, the chute 64 is secured at two discrete locations 66 at the opened first end 22 of the limb stall 20, at two discrete locations 68 at either side of the intermediate portion 36, and at discrete locations 72 at the base of the first 24, second 26, third 28, fourth 32, and fifth 34 digit stalls. The chute 64 is secured by way of eyelets 74 which are secured to the underlying apparel 10. However, such securement can be achieved by way of stitching and/or adhesives or other known conventional means. The regions between each of the discrete securements should take a curved or arcuate shape to allow for the passage of water beneath the entire chute. Furthermore, sufficient chute materials should be provided to allow for a bowing of the chute between each of the securements. Ideally, the chute is formed from a synthetic rubber to provide for sufficient resilience while at the same time maintaining a water proof article. As illustrated in FIG. 2 the chute includes a central opening 76. This opening 76 includes a length of cabling 78 which is formed within the periphery and allows for the opening 76 to be adjusted to various sizes. In this manner, various aquadynamic chute configurations can be achieved.

Figure 5:
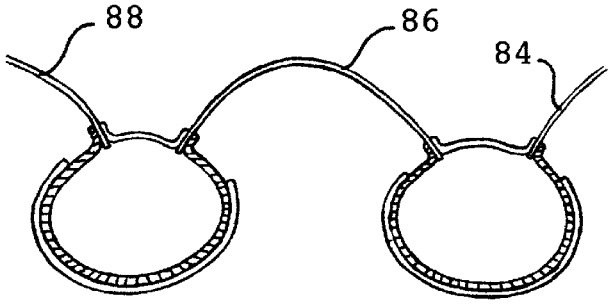
FIG. 5 is a cross sectional view of two of the limb stalls of the present invention.
Figure 7:
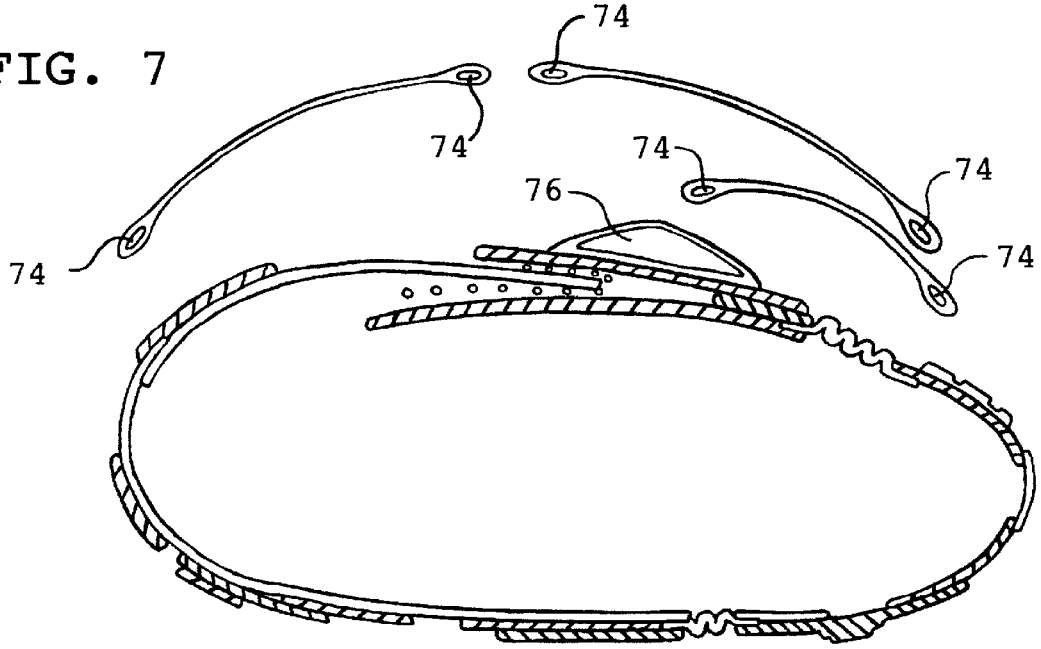
FIG. 7 is an exploded sectional view of the apparel of the present invention.

The article 10 of the present invention also employs a series of triangular webbing sections. Namely, a first webbing section 82 is secured to the dorsal side 38 of the limb stall 20. As with the dorsal chute 64 this web 82 includes a sufficient amount of material such that it achieves a bowed or parachute like configuration when deployed. Furthermore, as is evident from FIG. 2 the first webbing section 82 is adapted to cover the region between the first 24 and second 26 digits. A second webbing section 84 is similarly provided and covers the region between the second 26 and third 28 digit stalls. A third webbing 86 is secured intermediate the third 28 and fourth 32 digit stalls. Lastly, the fourth webbing 88 is provided between the fourth 32 and fifth 34 digit stalls. All of the webbings are secured to the adjacent digit stalls along their peripheral edges. FIG. 5 illustrates the manner in which the peripheral edges are joined to the underlying apparel material. Furthermore, all of the webbings are formed from sufficient material to allow the web to swell when it is in use. Such bowing increases the amount of drag a user encounters when maneuvering in an underwater environment. Nonetheless, it has been found that it is advantageous to include an aperture 92 at the lower portion, or apex, of the second 84, third 86, and fourth 88 webbings. FIG. 2 illustrates a phantom location of these various apatures. Namely, the oval shaped apertures 92 formed at the apex of each triangular shaped webbing portion. As is also evident in FIG. 2 the first 82, second 84, third 86, and fourth 88 webbings are preferably placed at a location beneath the dorsal chute 64. The two tiered relationship between the various webbing elements and the dorsal chute provides for optimal drag effects as the user is maneuvering his or her hand underwater. The increased drag provides for increased control and maneuverability in underwater environments.

With continuing reference to FIG. 2, the various finger harnesses or cots which are employed with the apparel of the present invention are depicted. Specifically, a first pair of harnesses 94 serve to interconnect the second 26 and third 28 digit stalls along their intermediate lengths. The first of this pair takes the form of an oblong flexible element which is disposed adjacent the fingertip portion of the digit stalls. The second of the pair 9takes the form of a more elongated cloth element and is situated approximate the base of the digit stalls. In a similar fashion a second pair of harnesses 96 are secured intermediate the third 28 and fourth 32 digit stalls. Again, the more oblong cloth element is situated adjacent the fingertips whereas the more elongated element is positioned near the base of the fingers. Lastly, a lone harness 98 serves to interconnect the fourth 32 and fifth 34 digit stalls. This lone harness 98 is positioned adjacent the base of the digit stalls. Each of these harnesses is preferably formed from an elastomeric material which provides a degree of flexibility and water resilience. The function of the harnesses is to ensure the relative position of each of the digit stalls with respect to one another in an optimal relationship.

This detailed description has been provided only for illustrative purposes. It is recognized that other embodiments may be articulated without departing from the objects and scope of the present invention. Any such modifications and variations are meant to be within the scope of the invention as contained within the following claims.

What is claimed as being new and desired to be protected by Letters Patent of the United States is as follows:

1. An article of apparel for use by participants in water activities comprising:

a limb stall having a first opened end adapted to accept the body part of a user and first, second, third, fourth, and fifth, digit stalls at the opposite second end thereof, and an intermediate portion therebetween, the limb stall having both a dorsal side and a front side;

a series of textured surfaces covering each of the digit stalls, the series of textures including an oval textured pattern at the outer most front side of each digit stall, and two textured sections formed along the intermediate length of the second, third, fourth, and fifth digit stall;

a dorsal chute formed upon the dorsal side of the limb stall, the dorsal chute being secured at a number of discrete locations, specifically two discrete locations at the opened first end of the limb stall, at two discrete locations at either side of the intermediate portion of the limb stall, and at discrete locations at the base of the first, second, third, fourth, and fifth digit stalls, a central opening formed within the dorsal chute, a length of cabling formed within the periphery of the opening to allow the opening to be adjusted to various sizes;

a first webbing section secured to the dorsal side of the limb stall, the first web covering the region between the first and second digit stalls;

a second webbing secured to the dorsal side of the limb stall, the second web covering the region between the second and third digit stalls;

a third webbing secured to the dorsal side of the limb, the third web covering the region between the third and fourth digit stalls; and a fourth webbing secured to the dorsal side of the limb stall, the fourth webbing covering the region between the fourth and fifth digit stalls;

a first pair of harnesses interconnecting the second and third digit stalls along their intermediate lengths;

a second pair of harnesses secured intermediate third and fourth digit stalls intermediate their length;

a lone harness interconnecting the fourth and fifth digit stalls along their intermediate length.

2. An article of apparel for use by participants in water activities comprising:

a limb stall having a first opened end adapted to accept the body part of a user and a plurality of digit stalls at the opposite second end thereof, and an intermediate portion therebetween, the limb stall having both a dorsal side and a front side;

a dorsal chute formed upon the dorsal side of the limb stall, the dorsal chute being secured at a number of discrete locations, a central opening formed within the dorsal chute, a length of cabling formed within the periphery of the opening to allow the opening to be adjusted to various sizes.

3. The article of apparel as described in claim 2 further comprising:

a series of textured surfaces covering each of the digit stalls, the series of textures including an oval textured pattern at the outer most front side of each digit stall, and two textured sections formed along the intermediate length of the second, third, fourth, and fifth digit stall.

4. The article of apparel as described in claim 2 further comprising:

a first webbing section secured to the dorsal side of the limb stall at three discrete locations, at a first location at the intermediate portion of the limb stall and at discrete locations upon the first digit stall and the second digit stall, the first web thus covering the region between the first and second digit stalls.

5. The article of apparel as described in claim 2 further comprising:

a second webbing secured to the dorsal side of the limb stall at three discrete locations, at a first location at the forward portion of the limb stall and at discrete locations upon the second digit stall and third digit stall, the second web thus covering the region between the second and third digit stalls.

6. The article of apparel as described in claim 2 further comprising:

a third webbing secured at three discrete locations, at a first location of the forward portion of the limb stall and at discrete locations upon the third digit stall and the fourth digit stall the third web thus covering the region between the third and fourth digit stalls.

7. The article of apparel as described in claim 2 further comprising:

a fourth webbing secured to the dorsal side of the limb stall at three discrete locations, at the forward portion of the limb stall and locations upon the fourth and fifth digit stalls, the fourth webbing thus covering the region between the fourth and fifth digit stalls.

8. The article of apparel as described in claim 2 further comprising:

a first pair of harnesses interconnecting the second and third digit stalls along their intermediate lengths;

a second pair of harnesses secured intermediate third and fourth digit stalls intermediate their length;

a lone harness interconnecting the fourth and fifth digit stalls along their intermediate length.

* * * * *